US005318286A

United States Patent [19]

Makiura et al.

[11] Patent Number: 5,318,286

[45] Date of Patent: Jun. 7, 1994

[54] PARALEL TRANSPORT APPARATUS

[75] Inventors: Yoshinori Makiura; Akinobu Nakahata; Kazumi Shirasaka; Kenji Oda; Masahiro Shinohara, all of Osaka; Kouji Migita, Fukuoka, all of Japan

[73] Assignee: Mita Industrial Co., Ltd., Osaka, Japan

[21] Appl. No.: 14,912

[22] Filed: Feb. 8, 1993

[30] Foreign Application Priority Data

Feb. 13, 1992 [JP] Japan ..... 4-026874

[51] Int. Cl.[5] ..... B65H 3/44

[52] U.S. Cl. ..... 271/9; 271/259

[58] Field of Search ..... 271/9, 10, 258, 259, 271/265, 262, 263, 279, 299, 300; 198/444, 460, 572, 573

[56] References Cited

U.S. PATENT DOCUMENTS

| | | | |
|---|---|---|---|
| Re. 26,896 | 5/1970 | Schmidlin et al. | 271/9 |
| 2,479,060 | 8/1949 | Davidson | 271/259 X |
| 4,718,538 | 1/1988 | Löw et al. | 198/572 X |
| 4,855,794 | 8/1989 | Suzuki | 271/9 X |
| 5,033,731 | 7/1991 | Looney | 271/258 X |
| 5,096,434 | 12/1991 | Sellers | 271/9 X |
| 5,125,635 | 6/1992 | Iwabuchi | 271/263 X |

FOREIGN PATENT DOCUMENTS

| | | | |
|---|---|---|---|
| 0077040 | 5/1985 | Japan | 271/9 |
| 0188356 | 8/1986 | Japan | 271/9 |
| 6424055 | 9/1989 | Japan . | |
| 0043147 | 2/1990 | Japan | 271/265 |
| 0204237 | 8/1990 | Japan | 271/9 |

*Primary Examiner*—H. Grant Skaggs
*Assistant Examiner*—Carol Lynn Druzbick
*Attorney, Agent, or Firm*—Jordan and Hamburg

[57] ABSTRACT

A parallel transport apparatus for transporting sheets side by side along a plurality of transport paths is provided with a feed roller which is brought into contact with uppermost sheets of a plurality of stacks of sheet contained side by side in a cassette and is adapted for feeding the uppermost sheets side by side; a separation roller pair arranged at a specified position of each of the plurality of transport paths and adapted for separating the sheets fed side by side so that one each of sheets are transported along the respective transport paths simultaneously; a sheet detector arranged downstream from the separation roller pair with respect to a sheet transport direction and adapted for detecting the presence or absence of sheets being transported side by side; and a multifeed discriminator for discriminating whether the multiple feeding has been occurred along any of the transport paths in accordance with an output from the sheet detector. Accordingly, the multiple feeding of sheets being transported side by side can be detected and coped with automatically.

3 Claims, 15 Drawing Sheets

PARALEL TRANSPORT APPARATUS

BACKGROUND OF THE INVENTION AND RELATED ART STATEMENT

This invention relates to a parallel transport apparatus provided with a function of detecting the multiple feeding of sheets transported side by side along a plurality of transport paths.

There have been known image forming apparatuses including copying machines and printers. In these image forming apparatus, sheets contained in a cassette are dispensed therefrom by a feed roller and are transported to a pair of separation rollers including a forward roller rotating along with the transport of sheets and a retard roller rotating against the transport of sheets. The fed sheets are separated by the separation rollers and are transported one by one to a specified position where registration rollers are arranged.

Downstream from the separation rollers is arranged a multifeed sensor for detecting the multiple feeding of sheets. In other words, there is arranged such a sensor as to confirm whether two or more sheets have been fed by the feed roller while being placed one over another. If the multiple feeding of sheets is detected, the rotation of the feed roller is stopped and a multifeed state is cleared manually, i.e., the sheets placed one over another are removed manually.

Recently, there has been known a printer, or like image forming apparatus in which data such as addresses output from a data storage provided in a personal computer are printed. In the image forming apparatus of this type, two stacks of sheets are contained side by side in the cassette. After the sheets are fed side by side from the cassette, toner images formed on a photosensitive member or the like are transferred to the sheets being transported side by side.

In this image forming apparatus including a parallel transport apparatus, the probability that the multiple feeding of sheets occurs increases as much as the number of transport paths is increased. If the multiple feeding occurs along either one of the transport paths, the rotation of the feed roller is stopped to clear the multifeed state. In addition, it is required to adjust the synchronization with the feed of sheets along the other transport path again. Accordingly, it has been very cumbersome to clear the multifeed state at an occurrence of the multiple feeding, compared to a sheet transport apparatus in which the sheets are transported along only a single transport path.

Further, if the rotation of the feed roller is stopped at each occurrence of the multiple feeding, the image forming apparatus cannot meet a recent demand of users to carry out a printing operation at a high speed. Thus, a device for transporting the sheets in the multifeed state automatically has been desired earnestly.

SUMMARY OF THE INVENTION

In view of the problems residing in the prior art, an object of the present invention is to provide a parallel transport apparatus capable of detecting the multiple feeding of sheets being transported side by side and of coping with the situation automatically at an occurrence of the multiple feeding of sheets.

Accordingly, the invention is directed to a parallel transport apparatus for transporting sheets side by side along a plurality of transport paths. The parallel transport apparatus comprises feed means which is brought into contact with uppermost sheets of a plurality of stacks of sheet contained side by side in a cassette and is adapted for feeding the uppermost sheets side by side; separation means arranged at a specified position of each of the plurality of transport paths and adapted for separating the sheets fed side by side so that one each of sheets are transported along the respective transport paths simultaneously; sheet detection means arranged downstream from the separation means with respect to a sheet transport direction and adapted for detecting the presence or absence of sheets being transported side by side; and multifeed discrimination means for discriminating whether the multiple feeding has occurred along any of the transport paths in accordance with an output from the sheet detection means.

With the parallel transport apparatus thus constructed, the sheets are fed side by side by the feed means, and are separated by the separation means to be transported one by one along each transport path. At this time, it is discriminated whether the multiple feeding has occurred based on the presence or absence of sheets being transported side by side.

The sheet detection means may preferably include a sheet detector provided for each transport path. Each sheet detector includes a rotatable member which is provided at such a position that the sheet being transported comes to contact therewith and is rotatable upon the contact with the sheet, and rotation detection means for detecting the rotation of the rotatable member.

In this parallel transport apparatus, the rotatable member rotates when the sheet being transported comes to contact therewith, and the presence or absence of sheets can be detected based on the detected rotation of the rotatable member along each transport path.

The sheet detection means may advantageously include a rotatable member and a single rotation detection means for detecting the rotation of the rotatable member. The rotatable member includes an actuating piece which is arranged at such a position along each transport path that the sheet being transported along the transport path comes to contact therewith, and is rotatable when the sheet comes to contact with at least one of the actuating pieces.

The rotatable member may further include a shaft extending in a direction normal to the transport paths and a single detecting piece extending toward the rotation detection means. This shaft is formed integrally with the actuating pieces. The actuating pieces and the detecting piece are rotatable about the shaft when the sheet comes to contact with at least one of the actuating pieces. The rotation detection means may detect the rotation of the detecting piece.

In this parallel transport apparatus, the rotatable member rotates when at least one of the sheets being transported comes to contact with the actuating piece, and the presence or absence of sheet is detected based on the detected rotation of the rotatable member. At this time, it is detected that the sheet is present in at least one of the transport paths.

The multifeed discrimination means may preferably include timer means for measuring a sheet presence period during which the presence of sheet is detected by the sheet detector means, and determination means for determining that the multiple feeding has occurred in the case where the sheet presence period is longer than a predetermined period.

In this parallel transport apparatus, it is determined that the multiple feeding has occurred when the sheet presence time becomes in excess of the predetermined period on the assumption that the presence of the remaining one of the sheets which have been fed simultaneously along one transport path has been detected.

There may be also provided control means for delaying the start of a next sheet feeding operation by a specified period when the multifeed discrimination means determines an occurrence of the multiple feeding.

In this parallel transport apparatus, the next sheet feeding operation is not carried out until the remaining sheet is transported.

The multifeed discrimination means may advantageously include timer means for measuring a period lasting from the start of the feeding by the feed means, and determination means for determining that the multiple feeding has occurred in the preceding sheet feeding operation when the sheet detection means detects the presence of a sheet before a specified period elapses following the start of the feeding by the feed means.

In this parallel transport apparatus, it is determined that the multiple feeding has occurred in the preceding sheet feeding operation when the presence of a sheet is detected before the specified period elapses following the start of the feeding on the assumption that the presence of the remaining sheet has been detected.

There may be provided control means for stopping an operation of the feed means immediately after the multifeed discrimination means determines an occurrence of the multiple feeding.

In this parallel transport apparatus, the next sheet feeding operation is not carried out until the remaining sheet is transported.

The rotation detection means may preferably include an optical sensor which consists essentially of a light emitting unit and a light receiving unit for receiving a light from the light emitting unit, and detects the rotation of the rotatable member depending upon whether the rotatable member is located on an optical path extending from the light emitting unit to the light receiving unit.

These and other objects, features and advantages of the present invention will become more apparent upon a reading of the following detailed description and accompanying drawings.

DETAILED DESCRIPTION OF THE PREFERRED EMBODIMENTS OF THE INVENTION

Figure 1:
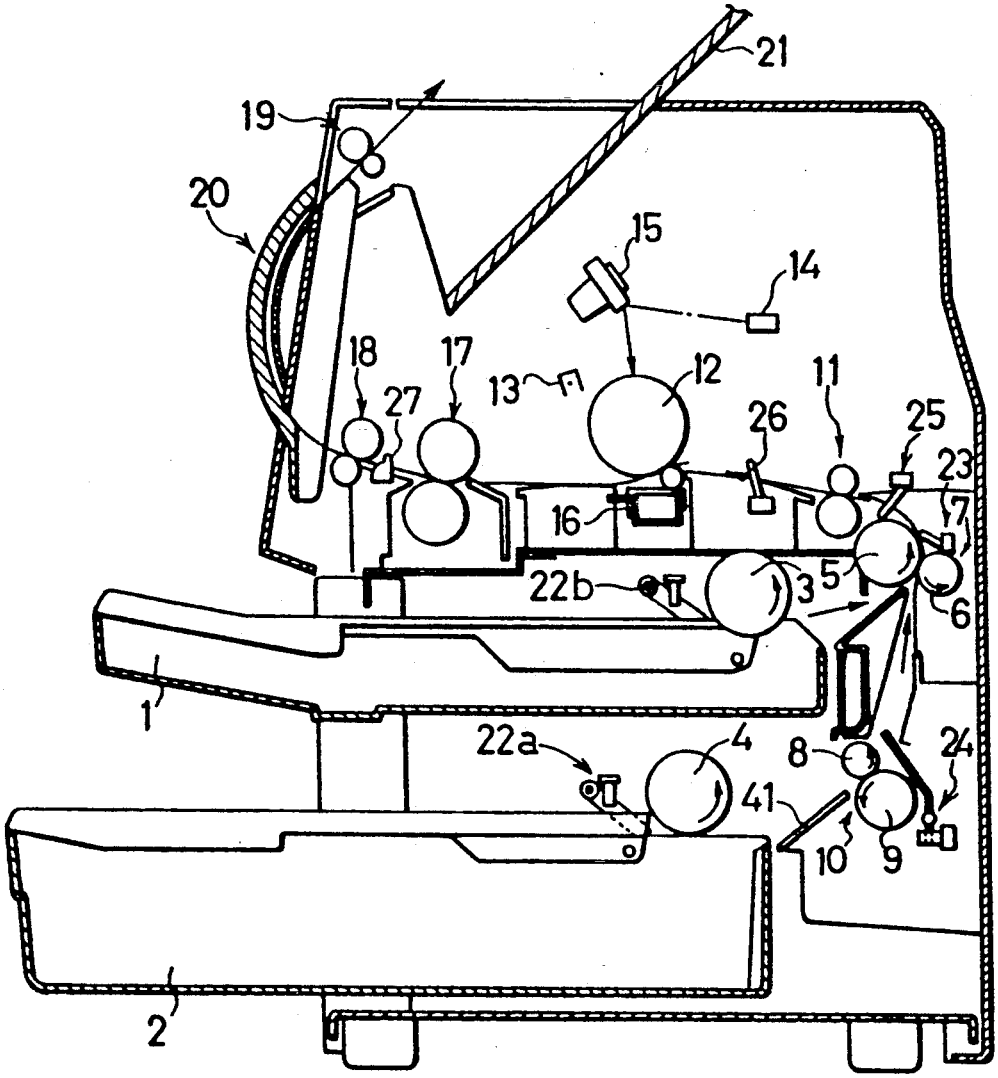
FIG. 1 is a sectional view showing a schematic construction of an image forming apparatus incorporating the invention.
Figure 2:
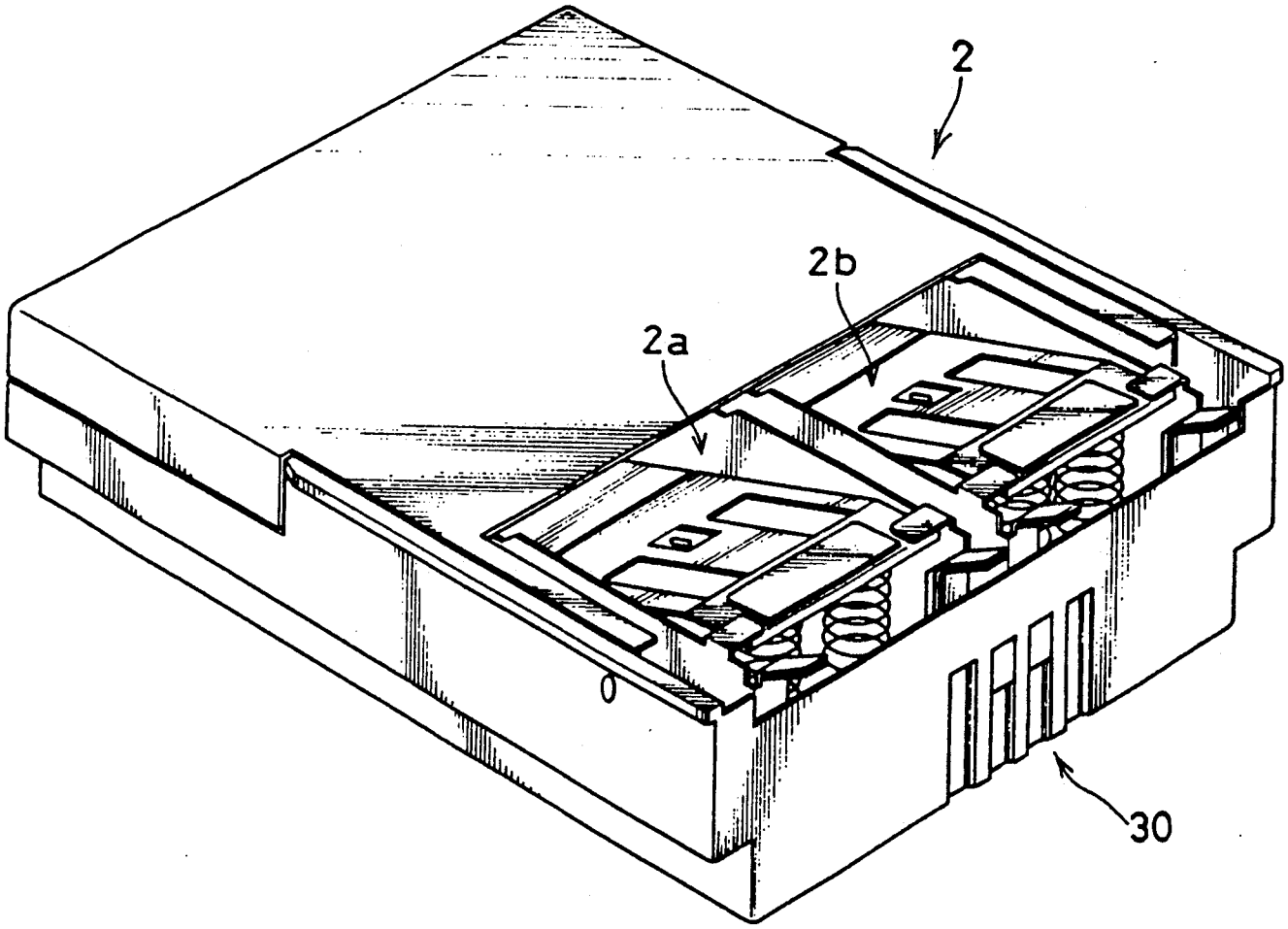
FIG. 2 is a perspective view showing a construction of a cassette.

There will be described a schematic construction of an image forming apparatus incorporating a parallel transport apparatus according to the invention with reference to FIGS. 1 and 2.

This image forming apparatus is provided with a cassette 1 for containing a single stack of sheets therein; a cassette 2 for containing two stacks of sheets therein; feed rollers 3, 4, first and second pairs of separation rollers 7, 10, a pair of registration rollers 11, a photosensitive member 12 in the form of a drum, a charger 13 and other unillustrated imaging devices arranged around the member 12, a light emitting device 14, a polygonal mirror 15, a transfer device 16, a fixing device 17, pairs of discharge rollers 18, 19, a discharge guide 20, a discharge tray 21, etc. The first separating roller pair 7 includes a forward roller 5 and a retard roller 6, and a second separating roller pair 10 includes a forward roller 8 and a retard roller 9. The light emitting device 14 includes a laser beam emitter for emitting a laser beam to print an image. The cassette 2 is internally provided with sheet aligning units **2*a*, 2*b*** arranged side by side.

The image forming apparatus is further provided with sheet sensors **22*a*, 22*b*, first and second multifeed sensors 23, 24, a registration sensor 25, a timing sensor 26, a discharge sensor 27**, and the like. The sheet sensor 22*a* detects the presence or absence of sheets in the sheet aligning units 2*a*, 2*b*. The sheet sensor 22*b* detects the presence or absence of sheets in the cassette 1. The multifeed sensors 23, 24 detect the multiple feeding of sheets. The registration sensor 25 is adapted for measuring a timing at which the registration rollers 11 are driven. The timing sensor 26 is adapted for measuring a timing at which the light emitting device 14 starts emitting the light. The discharge sensor 27 detects discharge of the sheet. Sensing devices of these sensors are adapted for detecting states of the sheets being transported side by side.

In thus constructed image forming apparatus, the sheets are dispensed from the respective stacks in the cassette 2 synchronously by the feed roller 4, and are fed to the second separation roller pair 10 while being guided by a feed guide 41. Along respective transport paths, the sheets are separated by the second separation roller pair 10 and transported one by one. Thereafter, the sheets come to contact with the registration roller pair 11 after passing through the first separation roller pair 7. When the sheets are fed from the cassette 2, the retard roller 6 is rotated idly such that the sheets having passed through the second separation roller pair 10 are allowed to pass through the first separation roller pair 7 smoothly. It is controllably discriminated based on data from a cassette information unit 30 provided at a front portion of the cassette 2 whether the retard roller 6 should be driven or not. The cassette information unit 30 consists of four bits, and a magnet is mounted to each of the desired bits thereof. Alternatively, the driving of the retard roller 6 may be controlled based on whether the cassette 2 has been selected through manual designation. The cassette information unit 30 outputs a signal representing the size of sheets contained in the cassette 2. The registration rollers 11 are driven controllably in accordance with a signal from the registration sensor 25.

Thereafter, when the registration rollers 11 start transporting the sheets and a sensor signal is output from the timing sensor 26, the photosensitive member 12 is driven in accordance with this sensor signal and image signals input from an unillustrated data storage of a storage medium externally connected to the image forming apparatus or arranged at a specified position thereof are optically modulated into modulated beams (laser beams) in the light emitting device 14, and emitted therefrom. The photosensitive member 12 is exposed to these laser beams introduced by way of the polygonal mirror 15. It may be appropriate to drive the photosensitive member 12 at a timing when the driving of the feed roller 4 is started. The surface of the photosensitive member 12 is charged by the charger 13, and electrostatic latent images are formed side by side on a charged region of the member 12 by an exposing operation. Thus formed electrostatic latent images are developed into toner images by an unillustrated developing device. These toner images are transferred to the respective sheets by the transfer device 16, and then fixed onto the sheets by the fixing device 17. Consequently, the sheets bearing the image are discharged onto the discharge tray 21 through the pairs of discharge rollers 18, 19 and the discharge guide 20.

There will be described a first cassette embodying the invention next with reference to FIGS. 3 to 7B.

First of all, a construction of the second multifeed sensor 24 will be described with reference to FIG. 3. The second multifeed sensor 24 is arranged at a specified position downstream from the second separation roller pair 10, and includes sensing devices 241, 242 for detecting the multiple feeding of sheets along the respective transport paths. The sensing devices 241, 242 include detecting members 121, 131 and detecting elements 122, 132 respectively. The detecting members 121, 131 include shafts 123, 133, detecting pieces 123, 133 fixed to the shafts 123, 133, and actuating pieces 125, 135 respectively. The actuating pieces 125, 135 are arranged across the transport paths so that the sheets being transported along the transport paths come to contact therewith, and bases thereof are fixed to the shafts 123, 133. The detecting elements 122, 132 detect movement of the detecting pieces 124, 134, and are provided with photointerrupters including pairs of light emitting elements 126, 136 and photodetectors 127, 137 respectively.

Figure 4A:
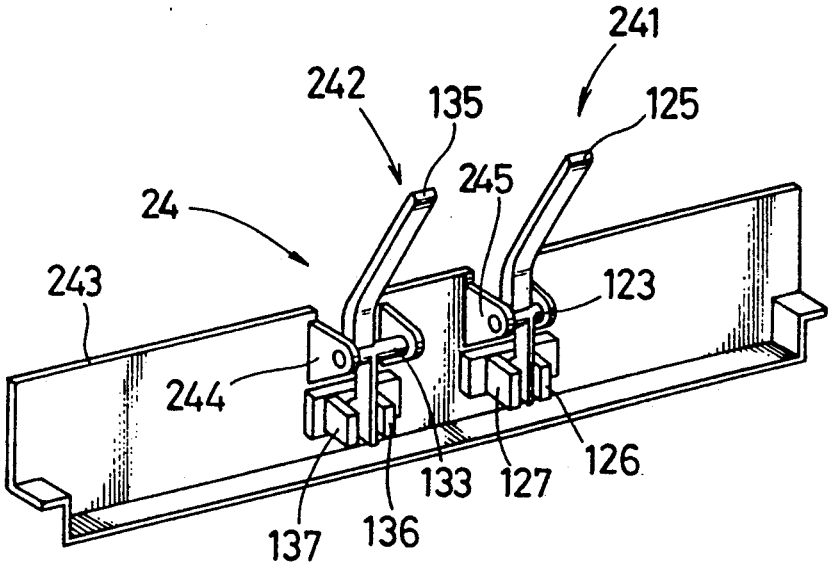
FIG. 4A is a perspective view showing a state where the second multifeed sensor is mounted on a panel.
Figure 4B:
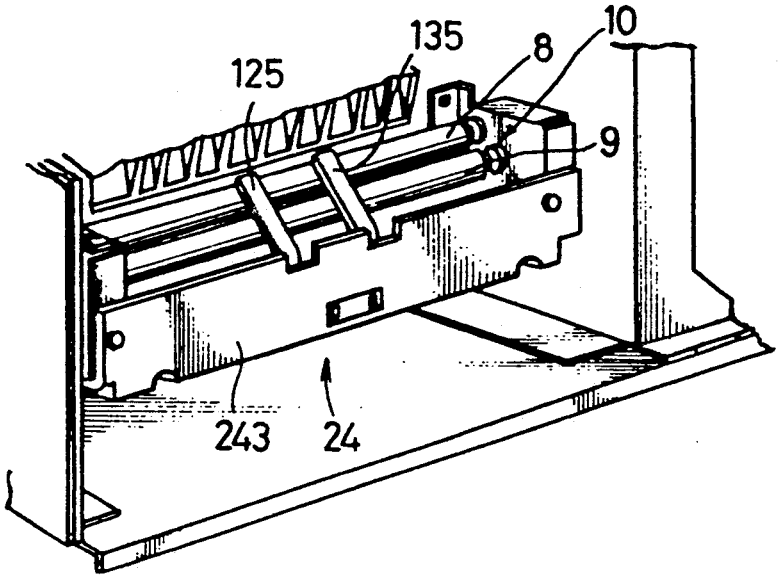
FIG. 4B is a perspective view showing a state where the panel having the second multifeed sensor mounted thereon is attached to the image forming apparatus.

As shown in FIG. 4A, the shafts 123, 133 are mounted rotatably on mount portions 244, 245 provided at a panel 243, which is secured to the image forming apparatus as shown in FIG. 4B so that the second multifeed sensor 24 is arranged downstream from the second separation roller pair 10.

Figure 3:
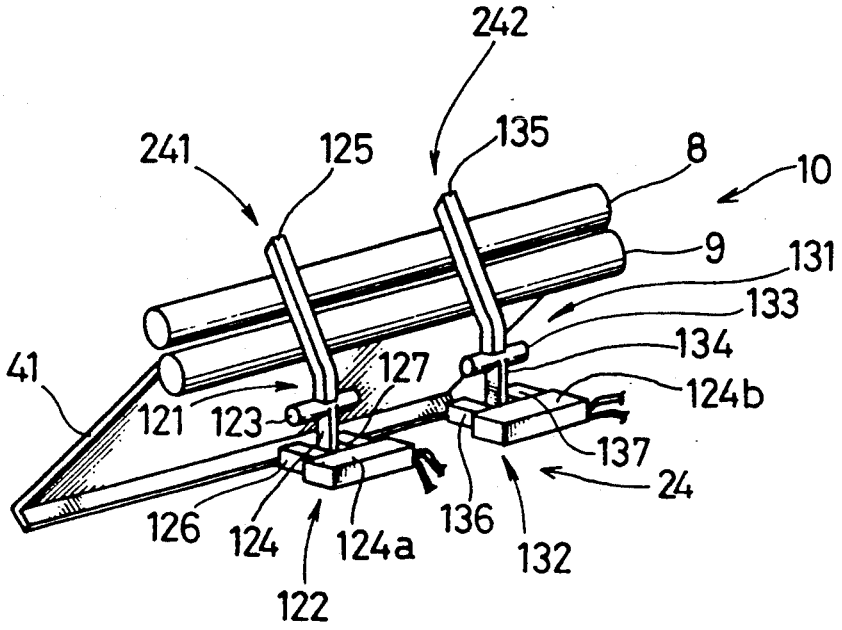
FIG. 3 is a perspective view showing a construction of a second multifeed sensor used in a first parallel transport apparatus embodying the invention.
Figure 5:
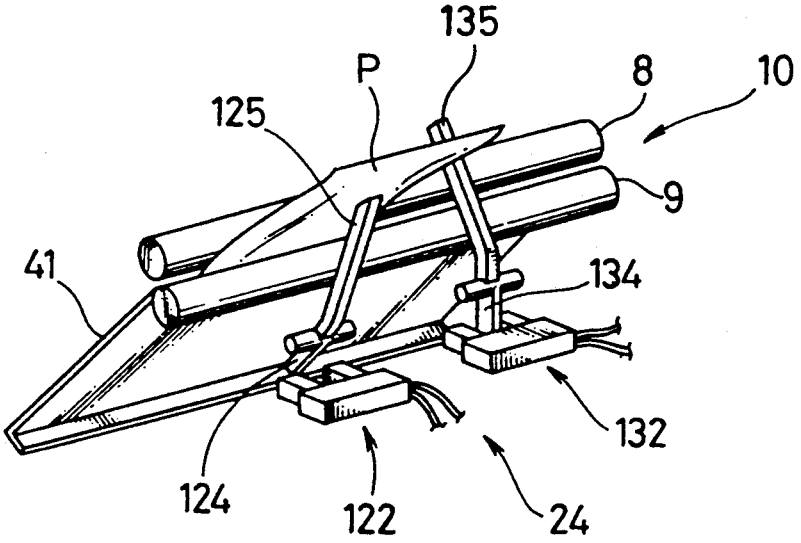
FIG. 5 is a perspective view showing an operation of the second multifeed sensor in the case where a sheet is transported along only one transport path.

The detecting element 122 (132) is off when the detecting piece 124 (134) is located in a clearance between the light emitting element 126 (136) and the photodetector 127 (137) due to the weight thereof as shown in FIG. 3. On the other hand, the detecting element 122 (132) is on when the actuating piece 125 (135) rotates upon the contact with a sheet P and thereby the detecting piece 124 (134) is located out of the clearance between the light emitting element 126 (136) and the photodetector 127 (137) as shown in FIG. 5.

Figure 6:
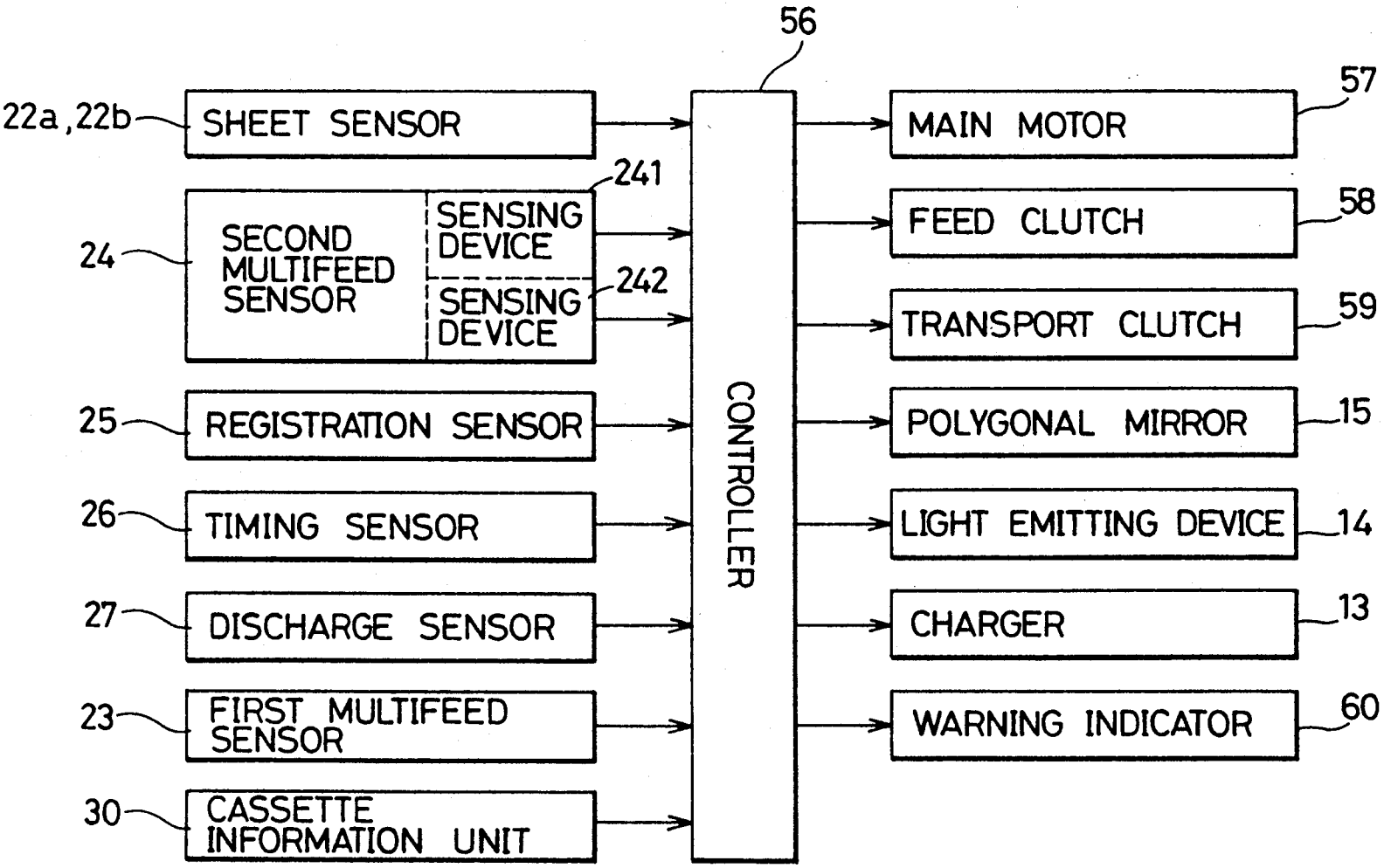
FIG. 6 is a block diagram showing a schematic construction of a control system provided in the image forming apparatus incorporating the first parallel transport apparatus.

There will be described a construction of a control system provided in the image forming apparatus incorporating the first parallel transport apparatus next with reference to FIG. 6.

This control system is provided with a controller 56, an input unit including sensors, an output unit including motors and clutches, and the like. The controller 56 sends a drive signal to the output unit in accordance with an input signal from the input unit.

The controller 56 includes a CPU or the like, and is adapted for processing image data to be reproduced and outputting the processed image data to the light emitting device 14 at an appropriate scanning timing. The controller 56 also controls a main motor 57, a feed clutch 58, a transport clutch 59, etc. in accordance with sensor signals from the sheet sensors 22*a*, 22*b*, the sensing devices 241, 242 of the first and second multifeed sensors 23, 24, the registration sensor 25, the timing sensor 26, and the discharge sensor 27.

Further, the controller 56 changes a value of a specified period T2 to be described later which is a reference for determining whether the sheets are fed while being placed one over another based on a sheet size data input from the cassette information unit 30. When the multiple feeding of sheets is detected, the controller 56 may send a signal to a warning indicator 60 arranged at a specified position of an upper surface of the image forming apparatus so as to inform an operator of the occurrence of the multiple feeding.

The main motor 57 drives the feed rollers 3, 4, the first and second separation roller pairs 7, 10, and the like through the feed clutch 58 and the transport clutch 59. When being engaged, the feed clutch 58 transmits a driving force of the main motor 57 to a sheet feeding mechanism including the feed rollers 3, 4, the first and second separation roller pairs 7, 10, and the like. When being engaged, the transport clutch 59 transmits the driving force of the main motor 57 to a sheet transporting mechanism including the registration roller pair 11, discharge roller pairs 18, 19, and the like.

Figure 7A:
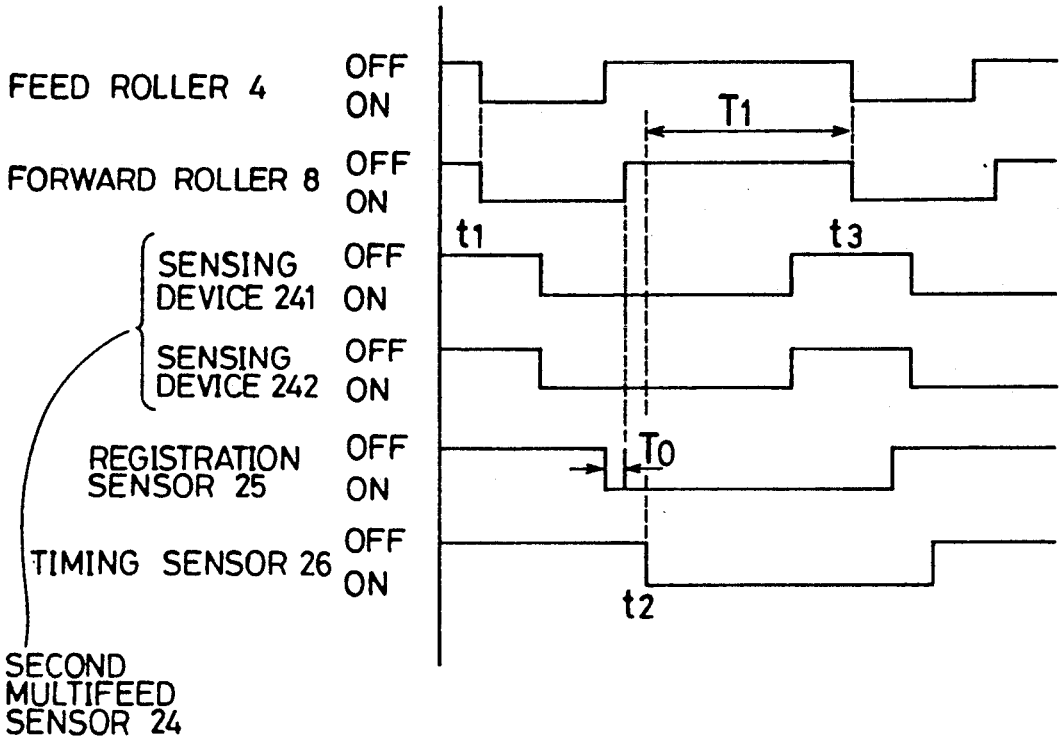
FIG. 7A is a timing chart showing operating states of respective elements when sheets are normally transported side by side.

An operation of the first embodiment will be described next with reference to FIGS. 7A and 7B. First, description will be given on a case where the sheets are transported normally with reference to FIG. 7A.

Upon the start of the operation at time t1, the main motor 57 is turned on. Then, the feed roller 4 starts rotating to thereby feed the sheets side by side, and the forward and retard rollers 8, 9 start rotating. As the sheets are transported along the transport paths, the second multifeed sensor 24 (sensing devices 241, 242) and the registration sensor 25 are turned on one after another. The forward roller 8 is kept driven for a specified period T0 after the registration sensor 25 is turned on, so that the sheets are nipped by the registration roller pair 11 reliably. Thereafter, the registration roller pair 11 are driven; the timing sensor 26 is turned on at time t2; and the sheets are transported to the photosensitive member 12. Upon the departure of the sheets, the respective sensors are turned off one after another. The feeding of the next sheets is started not after the turning-off of the timing sensor 26 but at time t3 after a specified period T1 following the turning-on (time t2) of the timing sensor 26 to carry out a continuous printing operation at higher speed. It should be noted that the specified period T1 is a control period to keep the next transported sheet from catching up to the previously transported sheet. This period T1 is specified in consideration of the driving timing of the registration roller pair 11, the distance between the cassette 2 and the registration roller pair 11, and the length of sheet to be transported.

Next, description will be given on a case where the sheets are fed while being placed one over another with reference to FIG. 7B. It is assumed that the multiple feeding has occurred along the transport path corresponding to the sensing device 241.

Upon the start of the operation at time t1, the main motor 57 is turned on. Then, the feed roller 4 starts rotating to thereby feed the sheets side by side, and the forward and retard rollers 8, 9 start rotating. At this time, if the multiple feeding of sheets occurs, one sheet is transported normally, but the other sheet(s) remains between the forward roller 8 and the retard roller 9. Accordingly, as the normally fed sheet is transported, the sensing unit 242, the registration sensor 25, and the timing sensor 26 are turned on one after another. Upon the departure of the normally transported sheet, the registration sensor 25 and the timing sensor 26 are turned off one after the other. Thereafter, the remaining sheet is transported. Because of the presence of the remaining sheet, the sensing device 241 is kept on. When the sensing device 241 is not turned off within the specified period T2, it is determined that the multiple feeding has occurred and the forward roller 8 is rotated again at time t14. The feeding of the next sheets is started at time t4 after lapse of a period required for this remaining sheet to be transported properly.

In this way, the multiple feeding is detected by the sensing devices 241, 242 along each transport path. Accordingly, at an occurrence of the multiple feeding, the controller 56 causes an image to be formed on a region of the surface of the photosensitive member 12 corresponding to the transport path along which the multiple feeding has occurred in synchronism with the transport of the remaining sheet. Thus, the image forming operation can be carried out to all the fed sheets without wasting any sheet, and it can be prevented that a region of the surface of the photosensitive member 12 corresponding to the transport path along which no sheet is transported is stained by the toner, or the like.

Figure 13A:
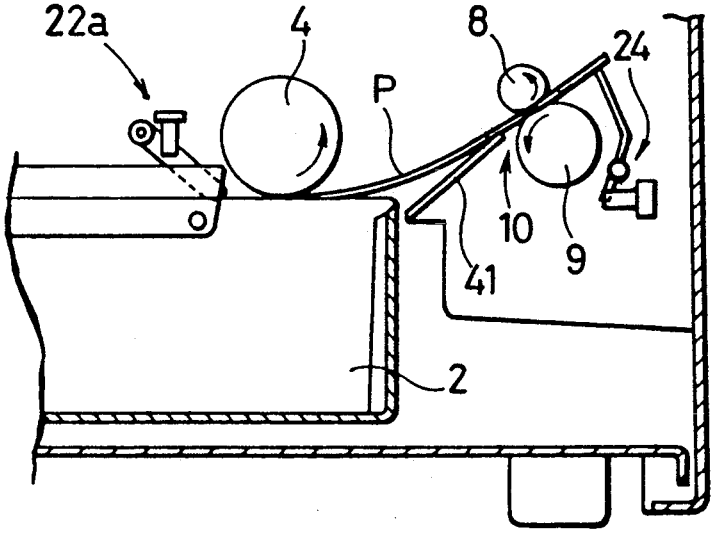
FIG. 13A is a diagram showing a state where a remaining sheet in a multifeed state is under a feed roller and the second multifeed sensor is an on-state.

In a case that the distance between the feed roller 4 and the second separation roller pair 10 is shorter than the length of sheet as shown in FIG. 13A, also, the remaining sheet is under the feed roller 4 while the second multifeed sensor 24 is turned on. In this case, the forward roller 8 is not rotated at time t14, and is rotated at time t4 so as to transport the remaining sheet in parallel with the next sheet in the transport path along which the previous sheet had been normally transported. In this way, the remaining sheet is prevented from catching up to the previous sheet in the process of being transported by the registration roller pair 11.

A second parallel transport apparatus embodying the invention will be described next with reference to FIGS. 8 to 12C.

Figure 8:
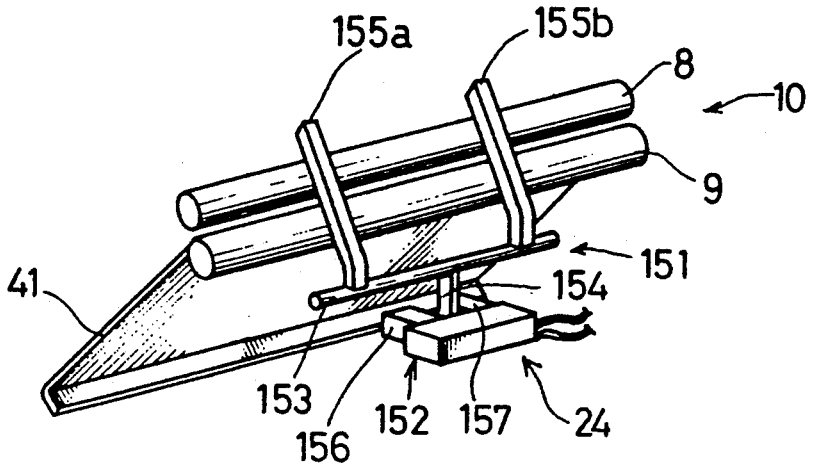
FIG. 8 is a perspective view showing a construction of a second multifeed sensor used in a second parallel transport apparatus embodying the invention.

There will be first described a construction of a second multifeed sensor 24 in a second embodiment with reference to FIG. 8. The second multifeed sensor 24 is provided with a detecting member 151 including actuating pieces 155*a*, 155*b* and a detecting element 152, and is designed to detect sheets being transported along respective transport paths by a single detecting element. The detecting member 151 includes a shaft 153, a detecting piece 154 fixed to the shaft 153, and the actuating pieces 155*a*, 155*b* arranged across the respective transport paths so that the sheets being transported along the transport paths come to contact therewith, and bases thereof are fixed to the shaft 153. The detecting element 152 detects movement of the detecting piece 154 and are provided with a photointerrupter including a pair of light emitting element 156 and photodetector 157.

Figure 9A:
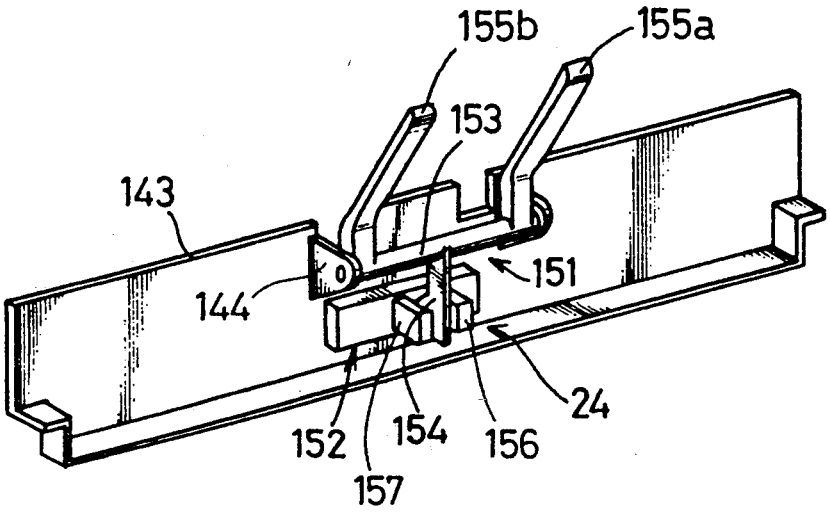
FIG. 9A is a perspective view showing a state where the second multifeed sensor is mounted on a panel.
Figure 9B:
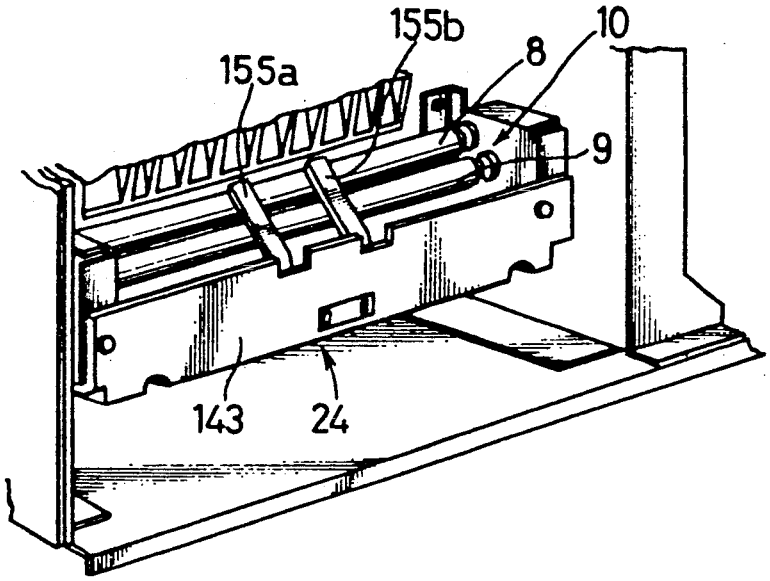
FIG. 9B is a perspective view showing a state where the panel having the second multifeed sensor mounted thereon is attached to the image forming apparatus.

As shown in FIG. 9A, the shaft 153 is mounted rotatably on a mount portion 144 provided at a panel 143, which is secured to the image forming apparatus as shown in FIG. 9B so that the second multifeed sensor 24 is arranged downstream from a second separation roller pair 10.

Figure 10:
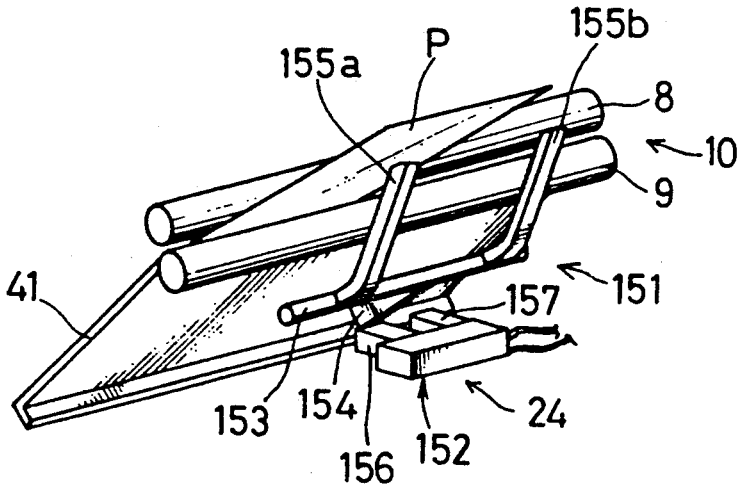
FIG. 10 is a perspective view showing an operation of the second multifeed sensor in the case where a sheet is transported along only one transport path.

The detecting element 152 is off when the detecting piece 154 is located in a clearance between the light emitting element 156 and the photodetector 157 due to the weight thereof as shown in FIG. 8. On the other hand, the detecting element 152 is on when the actuating piece 155*a* or 155*b* rotates upon the contact with a sheet P and thereby the detecting piece 154 is located out of the clearance between the light emitting element 156 and the photodetector 157 as shown in FIG. 10.

Figure 11:
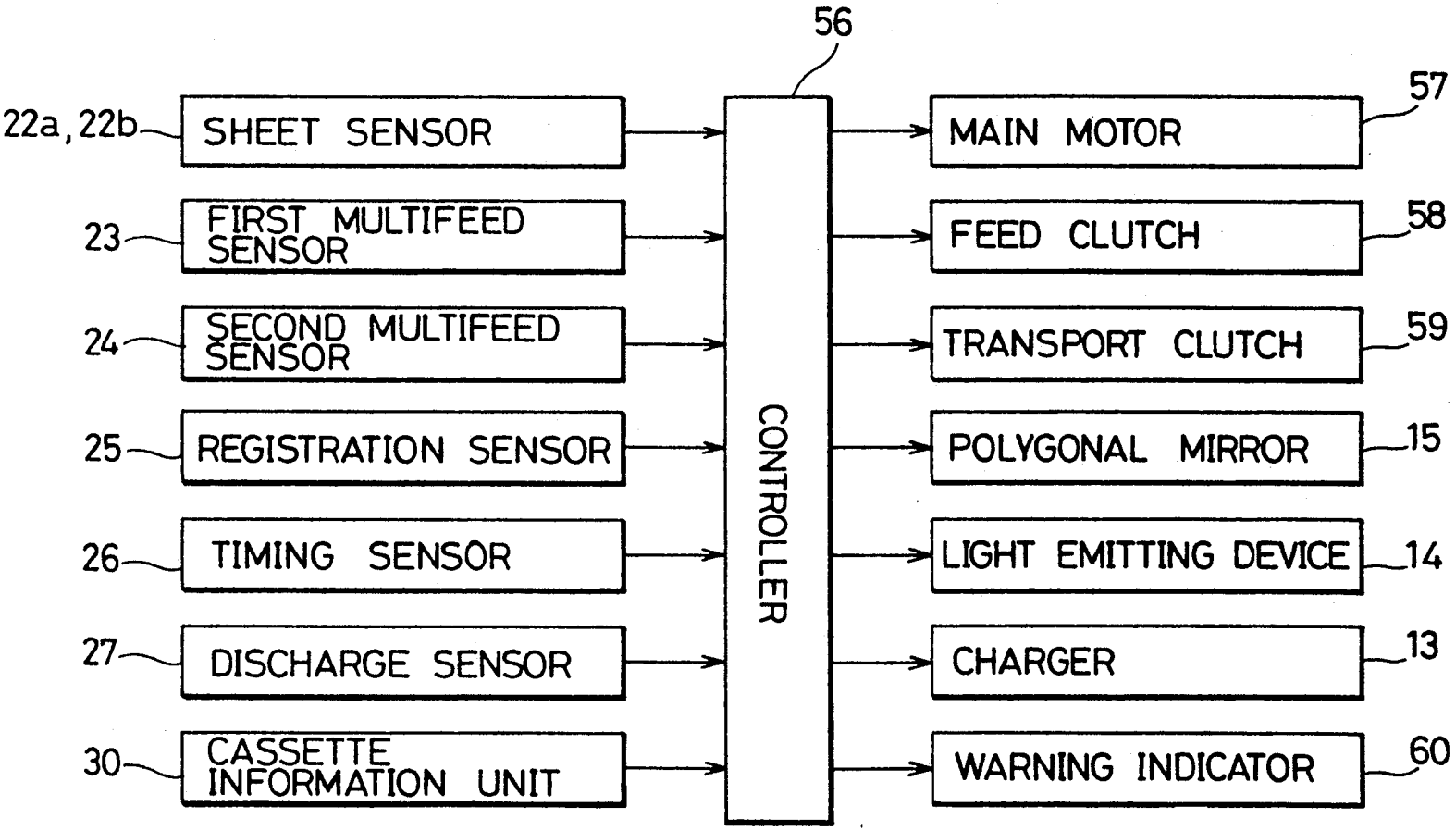
FIG. 11 is a block diagram showing a schematic construction of a control system provided in the image forming apparatus incorporating the second parallel transport apparatus.

FIG. 11 shows a construction of a control system provided in the image forming apparatus incorporating the second parallel transport apparatus. This control system is constructed substantially identical to the one of the first embodiment. However, since the second multifeed sensor 24 includes only the single detecting element 152 in this embodiment, only one signal line is provided between the second multifeed sensor 24 and the controller 56 so as to send a signal to the controller 56.

Figure 12A:
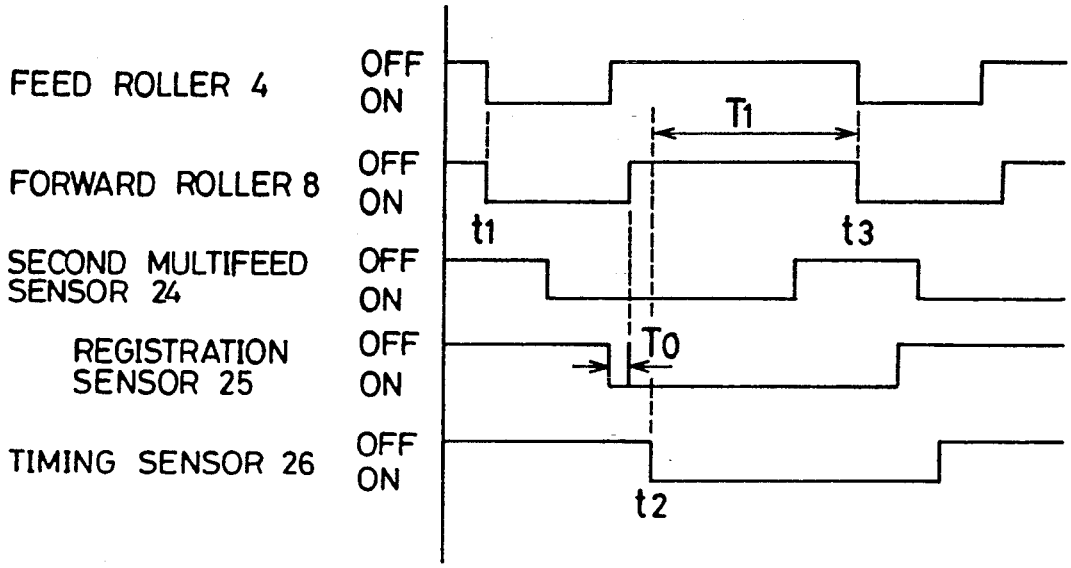
FIG. 12A is a timing chart showing operating states of respective elements when sheets are normally transported side by side.

An operation of the second embodiment will be described next with reference to FIGS. 12A to 12C, and 13. In the case where the sheets are transported normally, the operation of the second embodiment as shown in FIG. 12A is identical to that of the first embodiment as shown in FIG. 7A except that the second multifeed sensor 24 includes only the single detecting element. Accordingly, no description will be given on this case. Description will be given only on a case where the sheets are fed while being placed one over another with reference to FIGS. 12B and 12C.

Figure 7B:
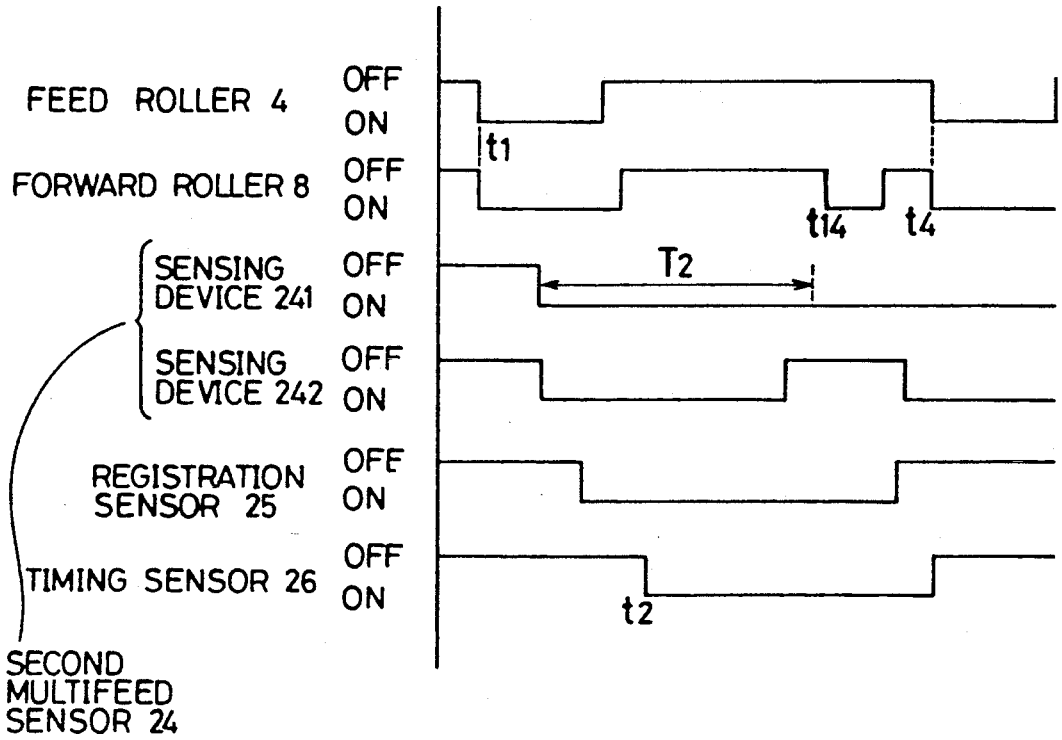
FIG. 7B is a timing chart showing the operating states of the respective elements when sheets are transported side by side while being placed one over another.
Figure 12B:
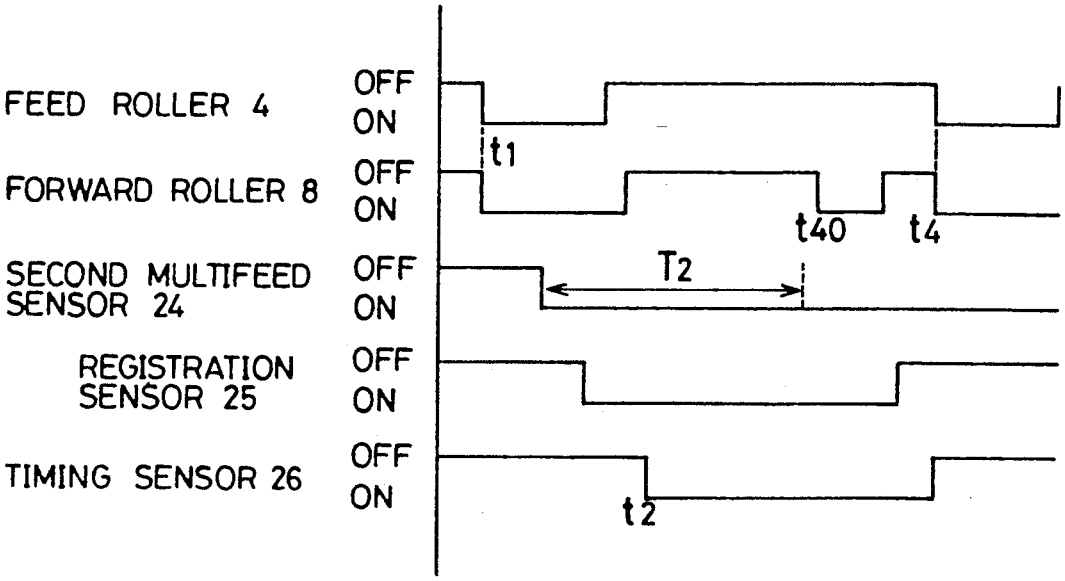
FIGS. 12B, 12C are timing charts respectively showing the operating states of the respective elements when sheets are transported side by side while being placed one over another.

FIG. 12B is substantially identical to FIG. 7B. Specifically, upon the start of the operation at time t1, a main motor 57 is turned on. Then, a feed roller 4 starts rotating to thereby feed the sheets side by side, and forward and retard rollers 8, 9 start rotating. At this time, if the multiple feeding of sheets occurs, one sheet is transported normally, but the other sheet(s) remains between the forward roller 8 and the retard roller 9. Accordingly, as the normally fed sheet is transported, the second multifeed sensor 24, the registration sensor 25, and the timing sensor 26 are turned on one after another. Upon the departure of the normally transported sheet, the registration sensor 25 and the timing sensor 26 are turned off one after the other. Thereafter, the remaining sheet is transported. Because of the presence of the remaining sheet, the sensing device is kept on. When the second multifeed sensor 24 is not turned off within a specified period T2, it is determined that the multiple feeding has occurred and the forward roller 8 is rotated again at time t40. The feeding of the next sheets is started at time t4 after lapse of a period required for this remaining sheet to be transported properly.

As described in the first embodiment, in the case that the remaining sheet is under the feed roller 4 while the second multifeed sensor 24 is turned on owing to the fact that the distance between the feed roller 4 and the second separation roller pair 10 is shorter than the length of sheet as shown in FIG. 13A, the forward roller 8 is not rotated at time t40, and is rotated at time t4 so as to transport the remaining sheet in parallel with the next sheet in the transport path along which the previous sheet had been normally transported. In this way, the remaining sheet is prevented from catching up to the previous sheet in the process of being transported by the registration roller pair 11. Further, this eliminates the need of suspending the operation of forming a latent image.

Figure 12C:
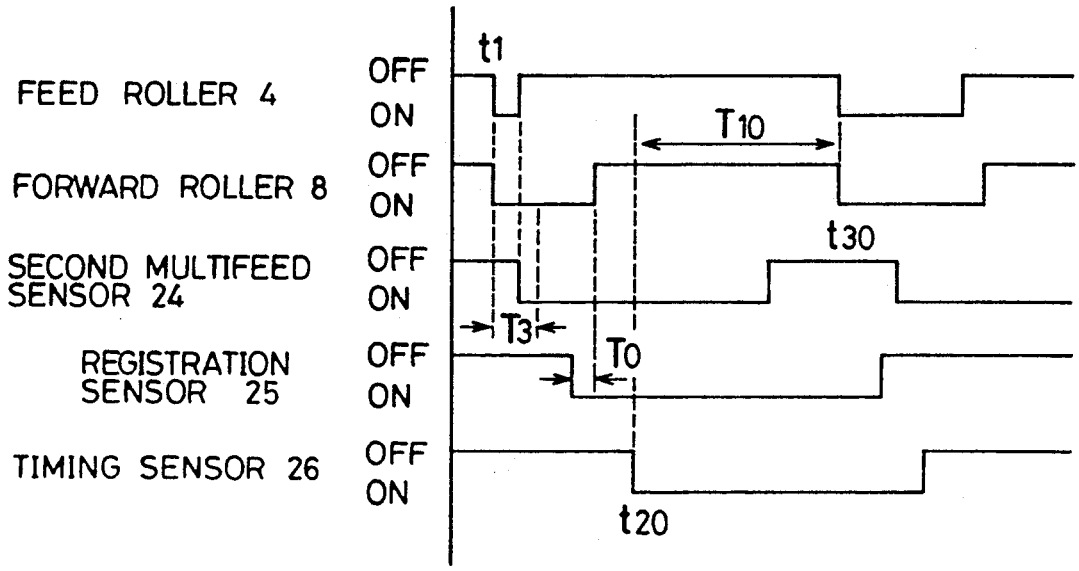
Figure 13B:
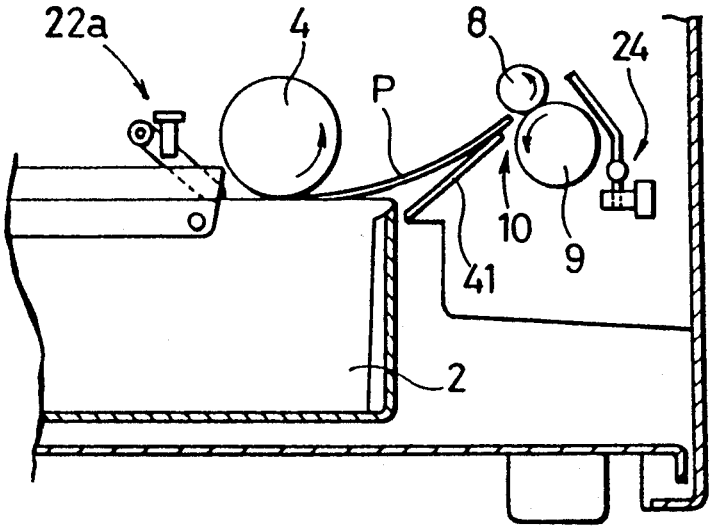
FIG. 13B is a diagram showing a state where one of the sheet in a multifeed state is left immediately upstream of a second pair of separation rollers.

Next, description will be given on an operation of this embodiment with reference to FIG. 12C in the case where one of the sheets P in the multifeed state is left immediately upstream from the second separation roller pair 10 as shown in FIG. 13B (at this time the second multifeed sensor 24 is off).

In this case, at time t1, the feed roller 4 starts rotating to thereby feed the sheets side by side, and the forward and retard rollers 8, 9 start rotating. Because of the presence of the remaining sheet P (see FIG. 13B), the second multifeed sensor 24 is turned on within a specified period T3. At this time, the rotation of the feed roller 4 is immediately stopped. The registration sensor 25 is turned on and the forward roller 8 is kept driven for a specified period T0 after the registration sensor 25 is turned on, so that the sheet is nipped by the registration roller pair 11 reliably. Thereafter, the registration roller pair 11 are driven; the timing sensor 26 is turned on at time t20; and the sheets are transported to the photosensitive member 12. Upon departure of the sheets, the respective sensors are turned off one after another. The feeding of the next sheets is started at time t30 after a specified period T10 following the turning-on of the timing sensor 26 (time t20).

The specified period T10 may be set equal to T1, or may be set shorter than T1 since a transport time of the remaining sheet P is shortened since it is dispensed from the cassette 2. With this setting, the sheets are allowed to be fed at a higher speed.

In FIGS. 12B and 12C, the controller 56 stops the image forming operation to the photosensitive member 12 while the remaining sheet P is transported. This is because it cannot be discriminated along which transport path the multiple feeding has occurred in the second embodiment. This arrangement prevents a region of the surface of the photosensitive member 12 corresponding to the transport path along which no sheet is transported from being stained by the toner, or the like.

Since an occurrence of the multiple feeding along either transport path can be detected by the single detecting element 152 of the multifeed sensor 24 in the second embodiment, the number of parts such as the detecting elements and wires can be reduced and the multifeed sensor can be accommodated in a smaller space.

Also, when the remaining sheet P is under the feed roller 4 as shown in FIG. 13B, the feed roller 4, forward roller 8, and retard roller 9 are immediately stopped. The rotation of these rollers 4, 8, and 9 is resumed after lapse of the predetermined time. In this way, the remaining sheet P is prevented from catching up to the previous sheet in the process of being transported by the registration roller pair 11. Further, this eliminates the need of suspending the operation of forming a latent image.

Figure 14:
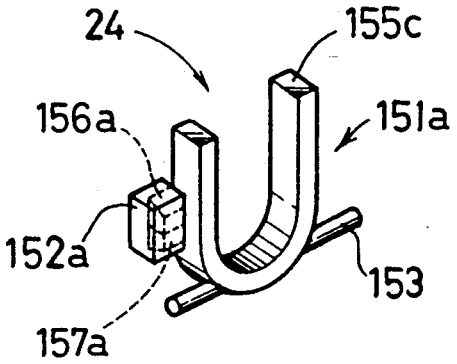
FIG. 14 is a perspective view showing another example of construction of the second multifeed sensor in the second embodiment.

The structure of the second multifeed sensor 24 is not limited to the one of the second embodiment. For example, as shown in FIG. 14, the detecting member 151*a* is formed into a substantially U-shaped figure. A shaft 153 is mounted at a base end portion of the member 151*a*, and free end portions of the member 151*a* are caused to face the respective transport paths as actuating members 155*c*. Further, a detecting element 152*a* may be a reflection type optical sensor provided internally with a light emitting element 156*a* and a photodetector 157*a*, and detects the movement of the actuating pieces directly.

Further, the detecting member 151*a* may be formed substantially V-shaped, and the detecting element 152*a* may be adapted for detecting the movement of a main body of the detecting member 151*a*.

Although two sheets are fed simultaneously side by side in the foregoing embodiments, three or more sheets may be fed in the similar manner. In this case, there may be provided the actuating pieces of the detecting member as many as stacks of sheets contained in a cassette.

Further, in order to detect the passage of the sheets directly, the second multifeed sensor 24 may be a transmission type optical sensor including a light emitting element and a photodetector arranged at upper and lower sides of the respective transport paths, or may be a reflection type optical sensor including a light emitting element and a photodetector arranged at the upper or lower side of the respective transport paths.

Although the present invention has been fully described by way of example with reference to the accompanying drawings, it is to be understood that various changes and modifications will be apparent to those skilled in the art. Therefore, unless otherwise such changes and modifications depart from the scope of the present invention, they should be construed as being included therein.

What is claimed is:

1. A parallel transport apparatus for transporting sheets side by side along a plurality of transport paths, comprising:

feed means which is brought into contact with uppermost sheets of a plurality of stacks of sheet contained side by side in a cassette for feeding the uppermost sheets side by side;

separation means arranged at a specified position of each of the plurality of transport paths and downstream of the feed means for separating the sheets fed side by side so that one sheet is transported along each respective transport path in a sheet transport direction and the sheets are simultaneously transported in the transport direction of the transport paths;

sheet detection means arranged downstream from the separation means with respect to the sheet transport direction for detecting the presence or absence of sheets being transported side by side, the sheet detection means including a rotatable member and a single rotation detection means for detecting the rotation of the rotatable member, the rotatable member including an actuating piece which is arranged at such a position along each transport path that one said sheet being transported along a respective said transport path comes into contact therewith, and the rotatable member being rotatable when the sheet comes into contact with at least one of the actuating pieces; and multifeed discrimination means receiving a signal from the sheet detection means for discriminating whether feeding of multiple sheets has occurred along any of the transport paths in accordance with a timing of the presence of said sheets detected by the sheet detection means.

2. A parallel transport apparatus according to claim 1 wherein the rotatable member further includes a shaft extending in a direction normal to the transport paths, the shaft being formed integrally with the actuating pieces, and a single detecting piece extending toward the rotation detection means, the actuating pieces and the detecting piece being rotatable about an axis of the shaft when the sheet comes into contact with at least one of the actuating pieces, and the rotation detection means detects the rotation of the detecting piece.

3. A parallel transport apparatus according to claim 1 wherein the rotation detection means includes an optical sensor comprised of light emitting means for emitting a light and light receiving means for receiving said light from the light emitting means, and the light emitting means and light receiving means are arranged on opposite sides of said rotatable member so that said light receiving means detects the rotation of the rotatable member, depending upon whether the rotatable member is located in an optical path extending from the light emitting means to the light receiving means.

* * * * *

UNITED STATES PATENT AND TRADEMARK OFFICE

CERTIFICATE OF CORRECTION

PATENT NO. : 5,318,286

DATED : June 7, 1994

INVENTOR(S) : Yoshinori Makiura et al

It is certified that error appears in the above-indentified patent and that said Letters Patent is hereby corrected as shown below:

On the title page, item [54] and in column 1, line 2, change the title from "ARALEL TRANSPORT APPARATUS" to --PARALLEL TRANSPORT APPARATUS--.

Signed and Sealed this

Thirtieth Day of August, 1994

*Attest:*

*Attesting Officer*

Bruce Lehman

BRUCE LEHMAN

*Commissioner of Patents and Trademarks*